US009854832B2

(12) United States Patent
Holford et al.

(10) Patent No.: US 9,854,832 B2
(45) Date of Patent: Jan. 2, 2018

(54) SMOKING ARTICLE WRAPPER AND METHOD OF MAKING A SMOKING ARTICLE

(71) Applicant: British American Tobacco (Investments) Limited, London (GB)

(72) Inventors: Steven Holford, London (GB); Aaron McKenzie, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 14/436,444

(22) PCT Filed: Oct. 16, 2013

(86) PCT No.: PCT/EP2013/071592
§ 371 (c)(1),
(2) Date: Apr. 16, 2015

(87) PCT Pub. No.: WO2014/060455
PCT Pub. Date: Apr. 24, 2014

(65) Prior Publication Data

US 2015/0272203 A1 Oct. 1, 2015

(30) Foreign Application Priority Data

Oct. 16, 2012 (GB) ..... 1218543.5
Aug. 6, 2013 (GB) ..... 1314043.9

(51) Int. Cl.
*A24C 5/00* (2006.01)
*A24D 1/02* (2006.01)
*A24C 5/10* (2006.01)

(52) U.S. Cl.
CPC ..... *A24C 5/005* (2013.01); *A24C 5/10* (2013.01); *A24D 1/02* (2013.01)

(58) Field of Classification Search
CPC ..... A24D 1/02; D21F 11/006
(Continued)

(56) References Cited

U.S. PATENT DOCUMENTS 2,804,078 A 8/1957 Saffir
3,524,450 A 8/1970 Molins et al.
(Continued)

FOREIGN PATENT DOCUMENTS

AT 282451 B 6/1970
CN 101171145 A 4/2008
(Continued)

OTHER PUBLICATIONS

Definition of "crease", Merriam-Webster dictionary, no date, [online], retrieved on Jun. 18, 2014]. Retrieved from the Internet <URL:http://www.merriam-webster.com/dictionary/crease>.
(Continued)

*Primary Examiner* — Anthony Calandra
(74) *Attorney, Agent, or Firm* — Cantor Colburn LLP

(57) ABSTRACT

Smoking article wrapper and method of making a smoking article A smoking article component comprises a curved sheet wrapper of weight 40 gsm or more that includes a plurality of lines of strength discontinuity at which the wrapper presents a visually discernable non-uniformity in its curvature. The wrapper can be used for example to wrap the filter of a cigarette as a plug wrap for the filter so as to comprise a wrapper of weight 80 gsm or more.

18 Claims, 20 Drawing Sheets

(58) Field of Classification Search
USPC ..... 162/109
See application file for complete search history.

(56) References Cited

U.S. PATENT DOCUMENTS

| | | | | | |
|---|---|---|---|---|---|
| 4,061,147 | A | | 12/1977 | Falchi | |
| 4,295,478 | A | | 10/1981 | Yeatts | |
| 4,302,654 | A | | 11/1981 | Bennett et al. | |
| 4,507,173 | A | * | 3/1985 | Klowak | B31F 1/12 156/183 |
| 4,535,793 | A | | 8/1985 | Luke | |
| 4,687,008 | A | | 8/1987 | Houck, Jr. et al. | |
| 4,716,912 | A | | 1/1988 | Leonard | |
| 5,092,350 | A | | 3/1992 | Arthur et al. | |
| 6,136,130 | A | * | 10/2000 | Tataryan | G09F 3/10 156/249 |
| 2005/0000533 | A1 | | 1/2005 | Yamada et al. | |
| 2007/0169786 | A1 | | 7/2007 | Li et al. | |
| 2007/0264461 | A1 | * | 11/2007 | Gelli | B32B 3/06 428/43 |
| 2008/0314399 | A1 | | 12/2008 | Ricketts et al. | |
| 2009/0320865 | A1 | | 12/2009 | Ning | |
| 2011/0023901 | A1 | | 2/2011 | Sherwood et al. | |
| 2011/0180088 | A1 | * | 7/2011 | Hooper | A24C 5/56 131/365 |
| 2012/0325230 | A1 | * | 12/2012 | Parrish | A24B 15/20 131/331 |
| 2013/0140197 | A1 | | 6/2013 | Fiebelkorn et al. | |

FOREIGN PATENT DOCUMENTS

| | | | | | |
|---|---|---|---|---|---|
| CN | 101462204 | A | | 6/2009 | |
| CN | 201250365 | Y | | 6/2009 | |
| CN | 201288274 | Y | | 8/2009 | |
| CN | 201288275 | Y | | 8/2009 | |
| CN | 101581062 | A | | 11/2009 | |
| CN | 101820782 | A | | 9/2010 | |
| CN | 101870038 | A | | 10/2010 | |
| DE | 202005020337 | U1 | | 3/2006 | |
| EP | 0325921 | A1 | | 8/1989 | |
| EP | 0281686 | B1 | | 7/1990 | |
| EP | 502538 | B1 | | 6/1995 | |
| EP | 0880905 | A1 | | 12/1998 | |
| EP | 1475003 | A1 | | 10/2001 | |
| EP | 0864014 | B1 | | 1/2002 | |
| EP | 1469999 | B1 | | 6/2006 | |
| EP | 2340728 | A1 | | 7/2011 | |
| EP | 2462821 | A1 | | 6/2012 | |
| EP | 2497382 | A1 | | 9/2012 | |
| GB | 567797 | A | | 3/1945 | |
| GB | 678393 | A | | 9/1952 | |
| GB | 876796 | A | | 9/1961 | |
| GB | 2236042 | A | | 3/1991 | |
| GB | 2280589 | A | | 2/1995 | |
| GB | 2479775 | A | | 10/2011 | |
| GB | WO 2011131529 | A1 | * | 10/2011 | A24C 5/005 |
| JP | EP 0584957 | A1 | * | 3/1994 | A24D 3/043 |
| JP | 2004248569 | A | | 9/2004 | |
| WO | 9720107 | A1 | | 6/1997 | |
| WO | 2003/065828 | A1 | | 8/2003 | |
| WO | 2011042353 | A1 | | 4/2011 | |
| WO | 2011042354 | A1 | | 4/2011 | |
| WO | 2011121326 | A2 | | 10/2011 | |
| WO | 2011121327 | A1 | | 10/2011 | |

OTHER PUBLICATIONS

Definition of "facet", Merriam-Webster dictionary, no date, [online], retrieved on Jun. 18, 2014]. Retrieved from the Internet <URL: http://www.merriam-webster.com/dictionary/facet>.

Definition of "score", Merriam-Webster dictionary, no date, [online], retrieved on Jun. 18, 2014]. Retrieved from the Internet <URL:http://www.merriam-webster.com/dictionary/score>.

Definition of "array", Merriam-Webster dictionary, no date, [online], retrieved on Jun. 18, 2014]. Retrieved from the Internet <URL:http://www.merriam-webster.com/dictionary/array>.

International Search Report and Written Opinion, dated Sep. 28, 2012, for PCT/EP2012/058627, filed May 10, 2012.

Written Opinion, dated Apr. 23, 2013, for PCT/EP2012/058627, filed May 10, 2012.

International Preliminary Report on Patentability, dated Aug. 5, 2013 for PCT/EP2012/058627, dated May 10, 2012.

International Search Report and Written Opinion, dated Jan. 15, 2014 for PCT/EP2013/071592, filed Oct. 16, 2013.

Office Action (w/ Search Report) dated May 10, 2012 by State Intellectual Property Office, P.R. China for Chinese Application No. 201280024455.6 (including translation in English).

Office Action, dated Jan. 6, 2015, for JP 2014-510739, referencing WO 2003/065828, JP 10-99067 (English counterpart EP 0880905), and JP 59-66874 (English counterpart U.S. Pat. No. 4,535,793) (English counterparts listed in SB08 for non-English references).

KR Office Action dated Jun. 15, 2016 re: Application No. 10-2015-7012715; pp. 1-10; citing: JP 2004-248569 and EP 2340728.

* cited by examiner

SMOKING ARTICLE WRAPPER AND METHOD OF MAKING A SMOKING ARTICLE

This application is the National Stage of International Application No. PCT/EP2013/071592, filed Oct. 16, 2013, which in turn claims priority to and benefit of United Kingdom Patent Application No. GB121.8543.5, filed Oct. 16, 2012, and which also claims priority to and benefit of United Kingdom Patent Application No. GB1314043.9, filed Aug. 6, 2013. The entire contents of the aforementioned applications are herein expressly incorporated by reference.

FIELD

This specification relates to a smoking article wrapper and a plug wrap that can be used in a smoking article filter for use in a smoking article such as a cigarette.

BACKGROUND

Smoking articles such as filter cigarettes generally have a smooth paper wrapper around their outside. A typical cigarette structure comprises a rod of tobacco or like smokeable material wrapped in a smooth paper wrapper, attached to the filter by a tipping paper. The filter may comprise filter material such as cellulose acetate tow with a wrapper termed a plug wrap.

SUMMARY

Embodiments of the present invention described herein provide a smoking article component including a curved sheet wrapper of weight 40 gsm or more that includes a plurality of lines of strength discontinuity whereat the wrapper presents a visually discernable non-uniformity in its curvature.

The plurality of lines of strength discontinuity can comprise lines of weakness for example partial cuts into the thickness of the sheet material.

The wrapper may for example have a weight of at least 45, 50, 55, 60, 70, 80 or 90 gsm and up to a weight of up to about 120 gsm and may comprise a tipping paper.

The smoking article component may be incorporated as a wrapper over the filter of a filter cigarette. The filter may be located in a fixed position or may be included in a telescopic arrangement.

An example of a machine for making a smoking article is described herein which applies a wrapper with an embossed pattern to a smoking article and includes a curling station at which the wrapper is passed over a rotary curling roller that includes a surface pattern to correspond the embossed pattern on the wrapper, and configured to weaken the wrapper to promote curling of the wrapper around the smoking article.

Embodiments of a wrapper described herein for a smoking article filter comprise a sheet wrapper of weight 80 gsm or greater that includes a plurality of lines of embossing such that the wrapper presents a visually discernable non-uniformity in its curvature, and includes lap seams along opposite side edges that include lines of weakness that permit intimate abutment of side edges of the wrapper around the filter.

The wrapper may have a weight of at least 90, 100, 115, 120, 125, 130 gsm, for example in the range of 80-150 gsm, 80-200 gsm, 90-150 gsm or 100-130 gsm. Its thickness may be in the range of 50 μm-115 μm and conveniently not exceeding 200 μm.

In another embodiment a wrapper for a smoking article filter comprises a sheet wrapper of weight 80 gsm or greater that includes a plurality of lines of embossing such that the wrapper presents a visually discernable non-uniformity in its curvature.

In a further embodiment a wrapper for a smoking article filter comprises a sheet wrapper that includes a plurality of lines of embossing such that the wrapper presents a visually discernable non-uniformity in its curvature, and includes lap seams along opposite side edges that include lines of weakness that permit intimate abutment of side edges of the wrapper around the filter.

The wrapper may comprise a generally rectangular web of sheet material embossed with a regular pattern of facets and side edges formed with line embossing in the regions of the lap seams.

Spaced bands of line embossing may extend transversely across the web so as to be suited to form a plug wrap for a filter.

Further specific features and advantages are embodied in and will be apparent from the claims set forth hereinafter.

BRIEF DESCRIPTION OF THE DRAWINGS

In order that the invention may be more fully understood embodiments thereof will now be described by way of illustrative example with reference to the accompanying drawings in which.

DETAILED DESCRIPTION

Overview

Several examples of smoking article are described hereinafter which make use of a smoking article component comprising a curved sheet wrapper that provides a distinctive visual appearance to the exterior of the smoking article. As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products, e-cigarettes, pressurised canister devices and other forms of inhaler. The smoking article may be provided with a filter for the gaseous flow drawn by the smoker. Some of the examples of smoking article described herein comprise a cigarette with a filter in a fixed location on a rod of smokeable material such as tobacco whereas others are telescopic in configuration. The curved sheet wrapper in the described embodiments is of a weight of 40 gsm or more, and includes a plurality of lines of strength discontinuity that may comprise lines of weakness configured so that that the wrapper presents a visually discernable non-uniformity in its curvature. Sheet material such as a tipping paper with a weight of 40 gsm or more gives rise to a particularly well defined visually discernable pattern when provided with the lines of strength discontinuity and formed into a curved wrapper, particularly above 40, 45, 50, 55, 60, 70, 80 and 90 gsm, and up to about 120 gsm in some embodiments. Conveniently, the thickness of the paper is within a range of 50 μm-115 μm for the range of weights 40-90 gsm.

Further preferred ranges are 50-150 gsm for tipping paper and 80-150 gsm for plug wrap. Conveniently, the upper limit for the thickness of the wrapper is 200 M.

The values of wrapper weight in gsm as discussed herein refer to the weight of the wrapper sheet prior to treatment to provide the lines of strength discontinuity therein such as lines of weakness formed by line embossing, described in more detail hereinafter, which may alter the wrapper weight slightly.

Telescopic Cigarette

Figure 1:
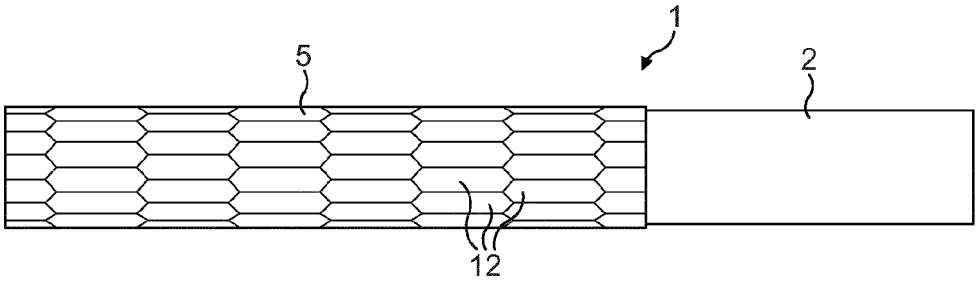
FIG. 1 is a side view of a smoking article comprising an extendible cigarette in an unextended configuration.
Figure 2A:
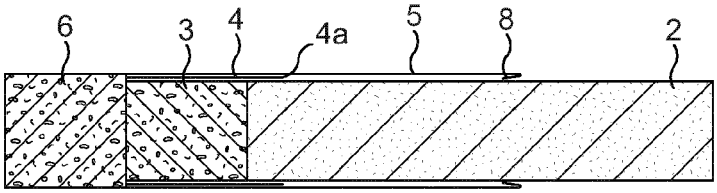
FIGS. 2*a* and 2*b* are longitudinal sectional views of the cigarette shown in FIG. 1 in unextended and extended configurations respectively.
Figure 2B:
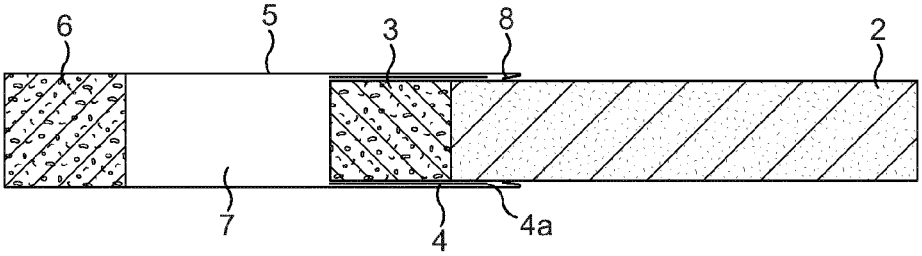

Referring to FIGS. 1 and 2, an extendable smoking article in the form of a telescopic cigarette 1 comprises a tobacco rod 2 that comprises tobacco in a paper wrapper, with an attached first filter section 3. The tobacco rod 2 and the first filter section 3 are attached to one another by a covering layer of sheet material e.g. paper, preferably tipping paper 4 as illustrated in FIG. 2.

A first component part comprises a sleeve 5 in the form of a cylindrical tube that extends around the circumference of the tobacco rod 2 and the first filter section 3. The tobacco rod 2 and the first filter section 3 are dimensioned to slide as a unit longitudinally within the sleeve 5. The tobacco rod 2 and first filter section 3 may be referred to as a tobacco unit or as a second part of the smoking article 1.

The first part may further comprise a second filter section 6 at a mouth piece end of sleeve 5, distal from the first filter section 3. The second filter section is securely attached within the sleeve 5. The first and second filter sections 3,6 may be circular in cross section and of the same diameter and conveniently be made of conventional cellulose acetate tow with a plug wrap.

A chamber 7 is defined in the sleeve between the first and second filter sections 3, 6. The chamber 7 is of variable length and hence volume as the first filter section slides axially within the sleeve 5. Relative movement of the first and second parts i.e. between the sleeve 5 and tobacco rod 2, beyond the maximum length is prevented by a re-entrant lip 8 formed at the distal end of the sleeve 5, which abuts a ridge on the tobacco rod 2 formed by the edge 4*a* of the tipping paper 4.

Figure 3:
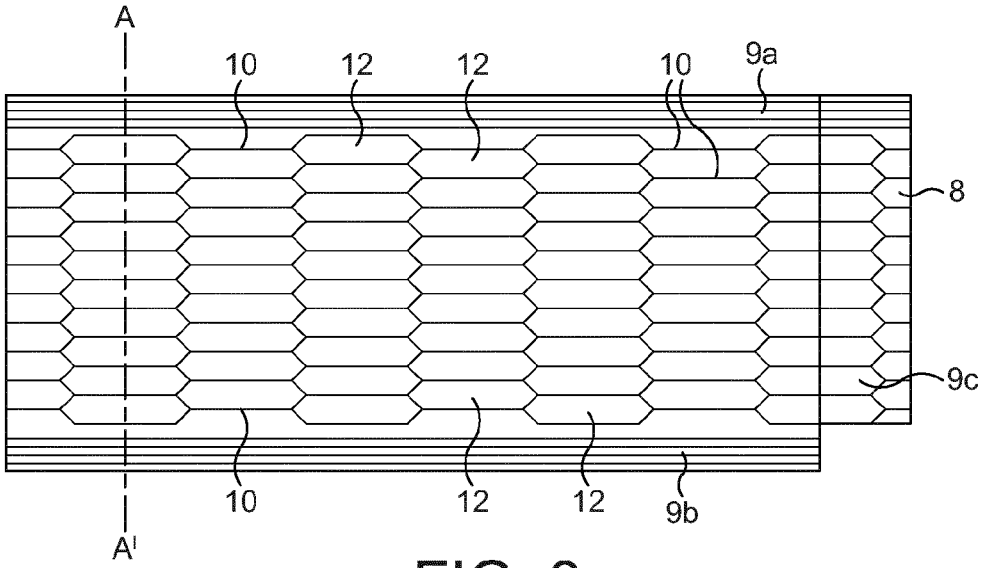
FIG. 3 is a plan view of the inside surface of the wrapper used in the cigarette shown in FIGS. 1 and 2.

As shown in FIG. 1, the exterior surface of the tubular sleeve 5 is embossed and presents an array of facets which on the exterior may be generally planar. The shape of the facets can be selected to achieve different visual effects and one example is illustrated in more detail in FIG. 3, which shows a blank 9 of sheet material that can be rolled up to form the tubular sleeve 5 around the second filter section 6. The tube 5 may be formed by gluing lap seams provided by peripheral edges 9*a*, 9*b* with line embossing as shown, to one another in an overlapping joint. Also, the re-entrant flap 8 can be created by folding region 9*c* of the blank inwardly.

The blank 9 includes a plurality of lines of strength discontinuity, in this example, lines of weakness 10, on the side of the blank 9 that forms the interior of tubular sleeve 5 so that the sleeve 5 when formed has a discontinuity in its radius at the lines of weakness 10. Thus, the wrapper blank 9 presents a visually discernable non-uniformity in its curvature when formed into the sleeve 5.

Figure 4:
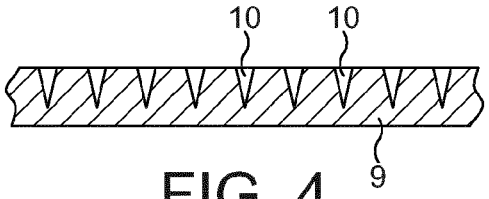
FIG. 4 is a partial sectional view through the thickness of the wrapper shown in FIG. 3 taken along line A-A'.

As illustrated in FIG. 4, the lines of weakness 10 may be formed by partially cutting into the sheet material that forms the blank 9. The cutting may conveniently be performed by laser cutting with one or more laser cutters which oscillate over the surface of the sheet material that forms blank 9. The depth of the cuts may be typically 50% of the thickness of the sheet material although the invention is not restricted to this depth. Preferably, the depth of the cutting comprises between 10-90% of the thickness of the blank. It will also be appreciated that the cutting can be performed using knife blades. The sheet material 9 that forms the blank may be used with the cuts on an inner or outer surface when forming a wrapper such as the sleeve 5. The lines of weakness can alternatively be formed by creasing the sheet material, by pinching the sheet material from both sides, or with other techniques such as embossing, which is described in more detail below.

Blanks 9 made from sheet material such as paper e.g. tipping paper with a weight of 40 gsm or more give rise to a particularly well defined pattern when formed into a curved wrapper such as the sleeve 5, particularly above 40, 45, 50, 55, 60, 70, 80 and 90 gsm and up to about 120 gsm. Conveniently, the thickness of the paper is within a range of 50 μm-115 μm for the range of weights 40-90 gsm.

Figure 5:
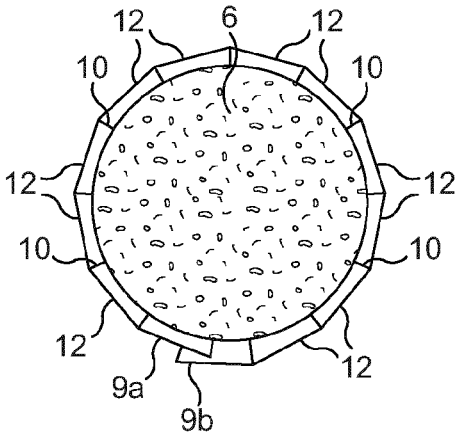
FIG. 5 is an enlarged sectional view of the wrapper taken along the line B-B' of FIG. 2*b*, when formed into a tube.

As illustrated in FIG. 5, upon formation of the tubular sleeve 5, with the blank 9 being wrapped around the cylindrical surfaces of the first and second filter units 3, 6, the wrapping process results in the slits 10 becoming closed so that the inner surface 11 conforms to the curvature of the cylindrical filter elements 3, 6, which are of the same diameter, whereas the outer surface of sleeve 5 comprises a series of facets 12 that are generally planar or at least have the radius of curvature different from that of the curvature of the inner surface 5*a*. Alternatively, the radius of curvature of the inner and outer surfaces can be constant. In either case, the facets may have a relatively large radius of curvature e.g. approximately planar, with a sharp bend at their edges at the lines of weakness 10. This gives rise to an array of visually discernable facets 12 illustrated in FIG. 1. The facets, for instance, result in the wrapper formed by the sheet material having a non-constant radius of curvature. It will be appreciated that the shape of the facets 5*b* can be selected depending on the pattern of the lines of weakness 10. In the example illustrated in FIG. 3, the pattern is generally similar to a fish net so that facets 12 have a generally ellipsoidal shape. However, many other different patterns can be envisaged, as illustrated in FIGS. 6, 7 and 8.

Referring to FIG. 6A-E, facets 13 for a particular blank may be of identical shape arrayed over the entire surface of the blank 9. Alternatively, as illustrated in FIG. 7, the facets 13 can be configured in a first array that may extend over the major part of the blank and facets 14 of a different shape to facets 13 in the first array, may be configured in a second array over the mouthpiece end of the blank 9. The facets 13 may have a closed perimeter which may be curved or polygonal in shape, or the facets may have an open shape such as parallel strips extending between spaced, parallel lines of weakness, for example the facets 14 extending longitudinally of the cigarette in FIG. 7 or in a zigzag or a spiral pattern (not shown).

Figure 6:
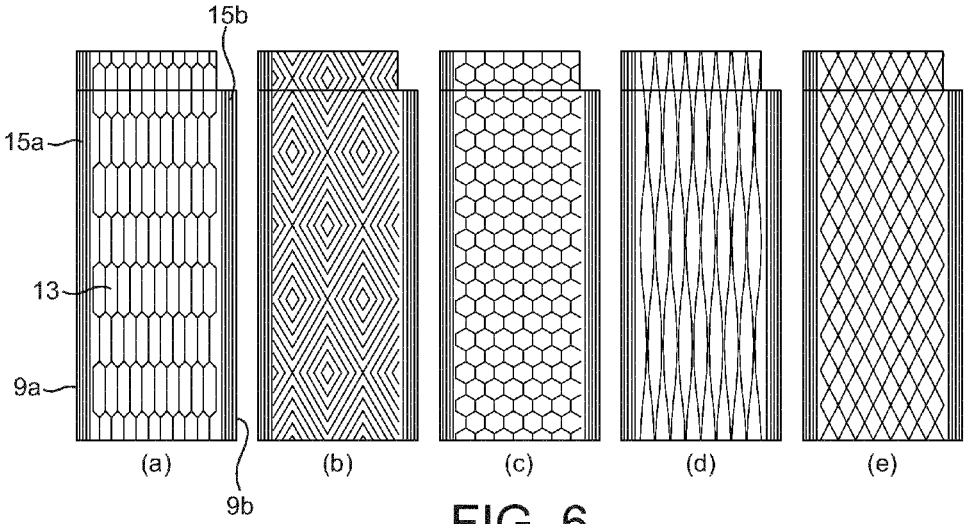
FIGS. 6*a*-6*e* illustrate alternative patterned blanks for use as the wrapper with different facet designs that extend in an array over the entire blank.
Figure 7:
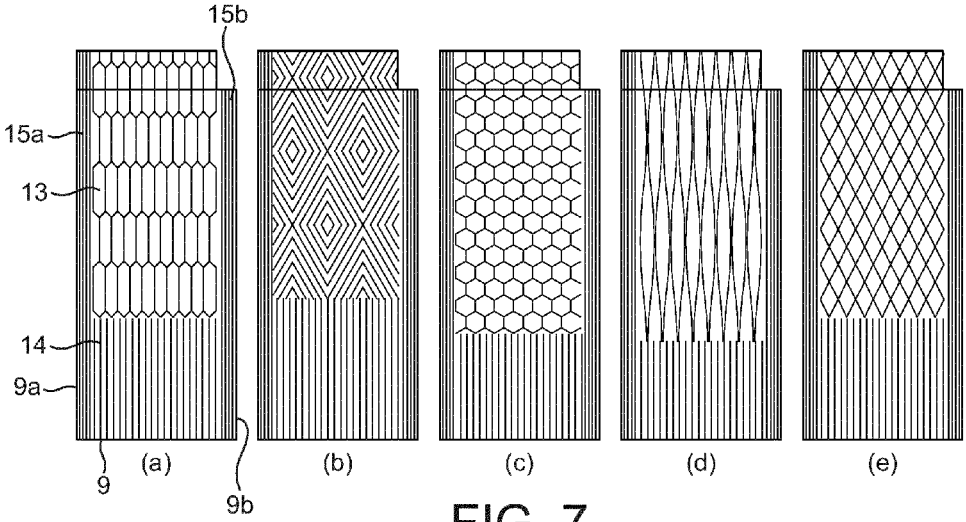
FIGS. 7*a*-7*e* illustrate alternative patterned blanks for use as the wrapper with first and second arrays of facets in different regions of the blanks.

As illustrated in FIGS. 6 and 7, longitudinal edge regions of the blank 9 may be formed with parallel, closely spaced lines of weakness 15*a*, 15*b* conveniently formed by line embossing to provide lap seams which facilitate wrapping the longitudinal edges onto one another when forming and gluing the curved wrapper 9 into the tubular sleeve 5.

Figure 8:
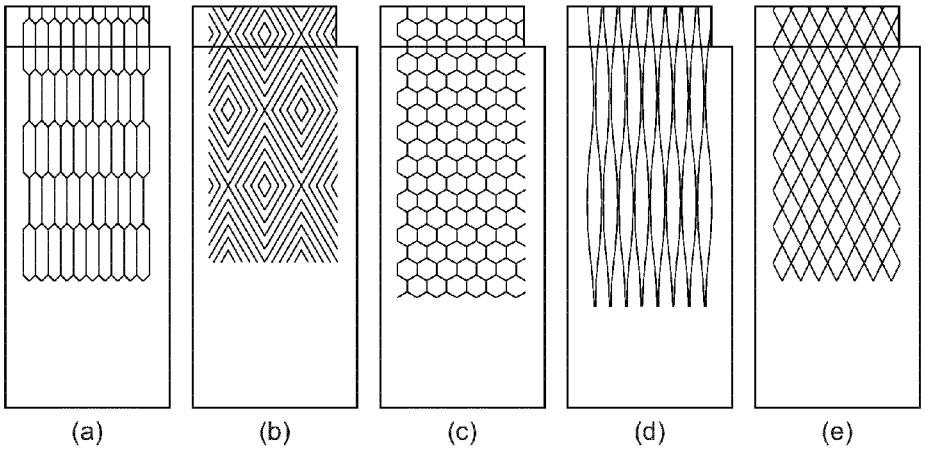
FIGS. 8*a*-8*e* illustrate alternative patterned blanks for use as the wrapper with an array of facets over only a part of the blanks.

As illustrated in FIG. 8, the mouthpiece end array of facets 14 may be omitted.

Figure 9:
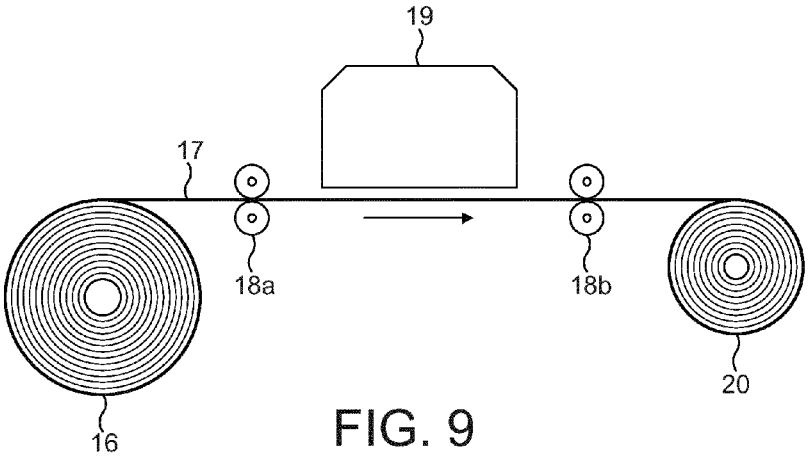
FIG. 9 is a schematic illustration of apparatus for forming the wrapper.
Figure 10:
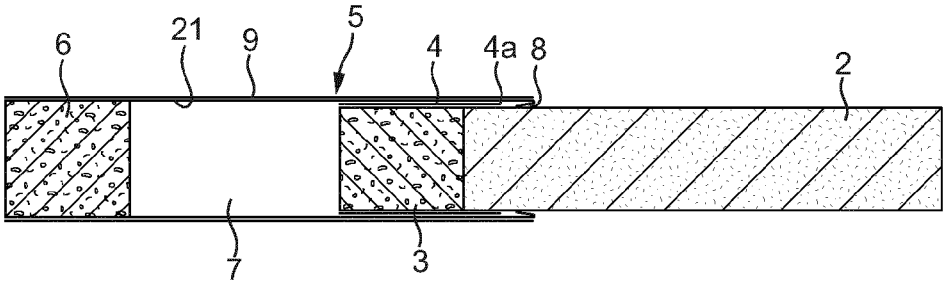
FIG. 10 is a longitudinal sectional view of a further example of an extendible cigarette in an unextended configuration.
Figure 11:
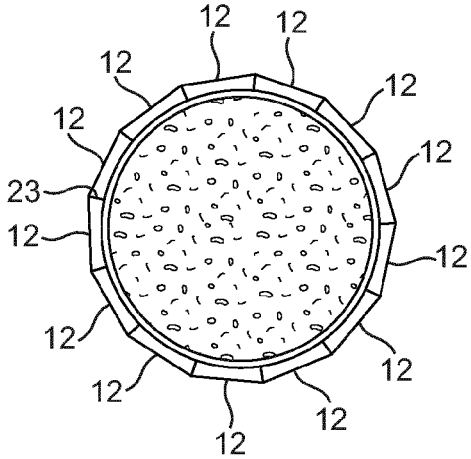
FIG. 11 is a mouth end view of the cigarette shown in FIG. 10.
Figure 12:
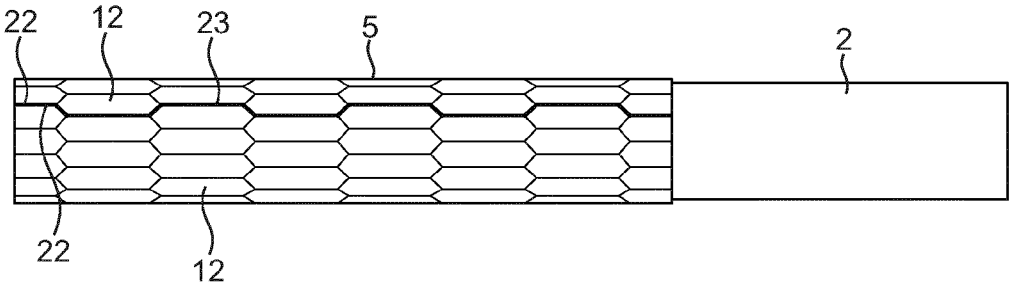
FIG. 12 is a side view of the cigarette shown in FIGS. 10 and 11.

FIG. 9 is a schematic illustration of apparatus for forming sheet material for use in the blanks 9. In this example a roll 16 of paper or like sheet material of the aforesaid weight is supplied as a continuous web 17 by means of two pairs of supply rollers 18 through a station 19 where the lines of strength discontinuity are formed. The station 19 may include one or more lasers that produce the lines of weakness 10 across the web 17. Alternatively the station 19 may include blades to cut the paper web 17 on one or both sides to form the lines 10, an arrangement to crease the paper web to form the lines of weakness or a pair of embossing rollers to apply the lines of weakness using pin embossing or other embossing techniques. The web 17 after leaving the station 19 may be fed into a take up roll 20 which is then taken to a filter rod making machine or to cigarette making machine for incorporation into cigarettes. Thus the paper is prepared off-line from the cigarette making machine in a preparatory process. By way of background, an example of how the web 17 may be incorporated into a process for forming the telescopic cigarette is described in our PCT/GB2011/050499. Alternatively, the web 17 and the station 19 may be provided on-line at the cigarette making machine for forming the lines of weakness in the web just before it is supplied into the making machine.

Whether prepared on or off-line from the cigarette making machine, the web 17 may also be printed or embossed with logo style or other information, and the printing or embossing may be performed in a predetermined registry with the pattern of facets 12, for example so that the printing or embossing is configured within individual ones of the facets.

Another example of extendible cigarette is illustrated in FIGS. 10 to 13. In this example the sleeve 5, instead of being made solely of the facetted blank 9 as in FIGS. 1 to 4, also includes an underlying support layer 21 to which the blank 9 may be affixed by gluing or other suitable means evident to those skilled in the art. The support layer 21 may comprise a rectangular, rolled blank of sheet material such as paper and is formed with the re-entrant lip 8 so as to limit the extension of the tobacco rod 2 along the sleeve 5 by engaging the edge 4*a* of tipping paper 4 which holds the filter 3 on the end of the tobacco rod 2, in a similar fashion to the lip 8 described with reference to FIGS. 1 to 4. The support layer 21 is glued to the filter 6. With the support layer 21, the paper weight for the blank 9 can be in a range of 50-60 gsm to provide a good visual effect e.g. a tipping paper of weight 58 gsm.

In the example shown in FIGS. 10 to 13, the blank 9 is formed with a regular pattern of facets 12 that comprise irregular hexagons that resemble a fish net in a similar pattern to that shown in FIG. 1. However, unlike FIG. 1, the blank 9 shown in FIG. 10 has longitudinal side edges 22, one of which is shown more clearly in FIG. 13, which follow the edges of the facets 12 so that they can be arranged in a butt joint 23 illustrated in FIGS. 11 and 12, with the advantage that the pattern of facets 12 can run continuously around the exterior of the sleeve without a discontinuity that can be felt in the finger of the hand or which is visible to the user.

Figure 13:
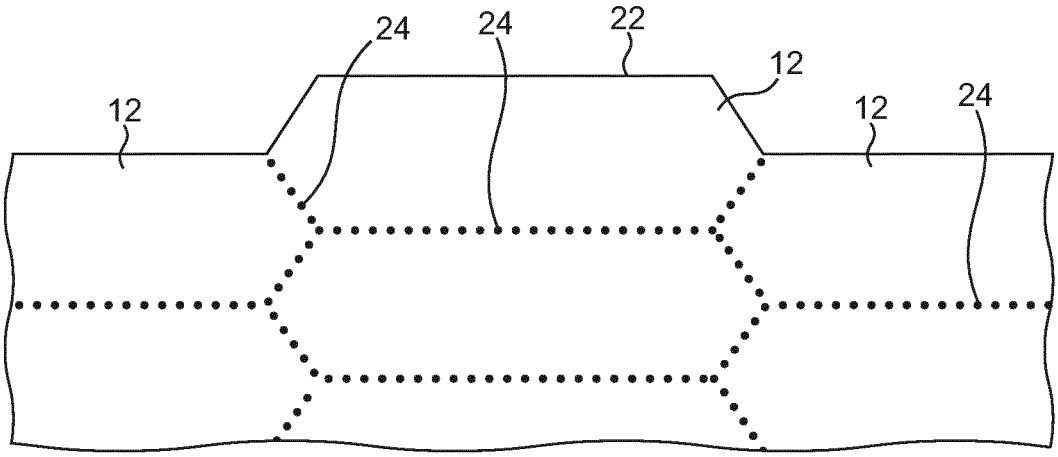
FIG. 13 is an enlarged view of a portion of a wrapper in which lines of weakness have been formed by pin embossing.

In the example shown in FIG. 13, the lines of weakness 10 are formed by pin embossing, which produces a line of pin pricks 24 around the perimeter of the facets. The pin pricks 24 can be formed using a roller that has a pattern of pins around its periphery, which is included in the station 19 shown in FIG. 9, so that upon rotation of the roller in engagement with the web 16, the pattern of pin pricks shown in FIG. 13 is produced.

Fixed Filter Cigarette

Some examples of smoking article with a fixed filter will now be described that utilise a wrapper with an embossed pattern.

Figure 14:
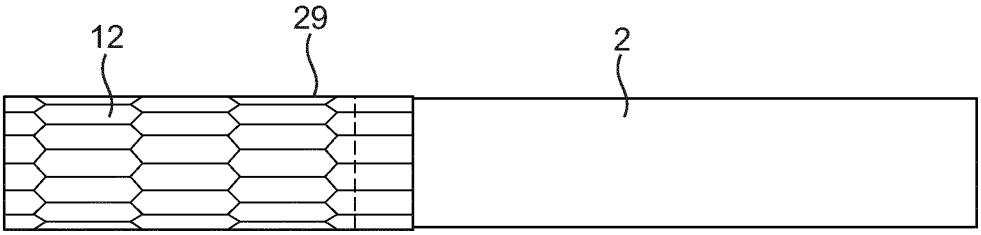
FIG. 14 is a side view of a smoking article comprising a fixed filter cigarette.
Figure 15:
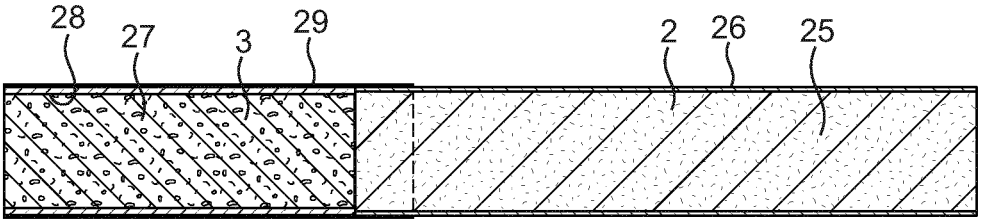
FIG. 15 is a longitudinal sectional view of the cigarette shown in FIG. 14.

Referring to FIGS. 14 and 15, a fixed filter cigarette comprises a tobacco rod 2, which in a conventional manner comprises smokeable material such as tobacco or tobacco containing material 25 wrapped in a paper wrapper 26. A generally cylindrical filter segment 3 that comprises filter material, for example cellulose acetate 27 wrapped in a paper plug wrap 28, is attached to the tobacco rod 2 by means of a tipping wrapper 29 which has been embossed with an array of facets 12 in the manner previously described with reference to FIG. 9, such that the wrapper 29 can be formed as a cut segment from a web 17 that has been provided with the embossed pattern.

Figure 16:
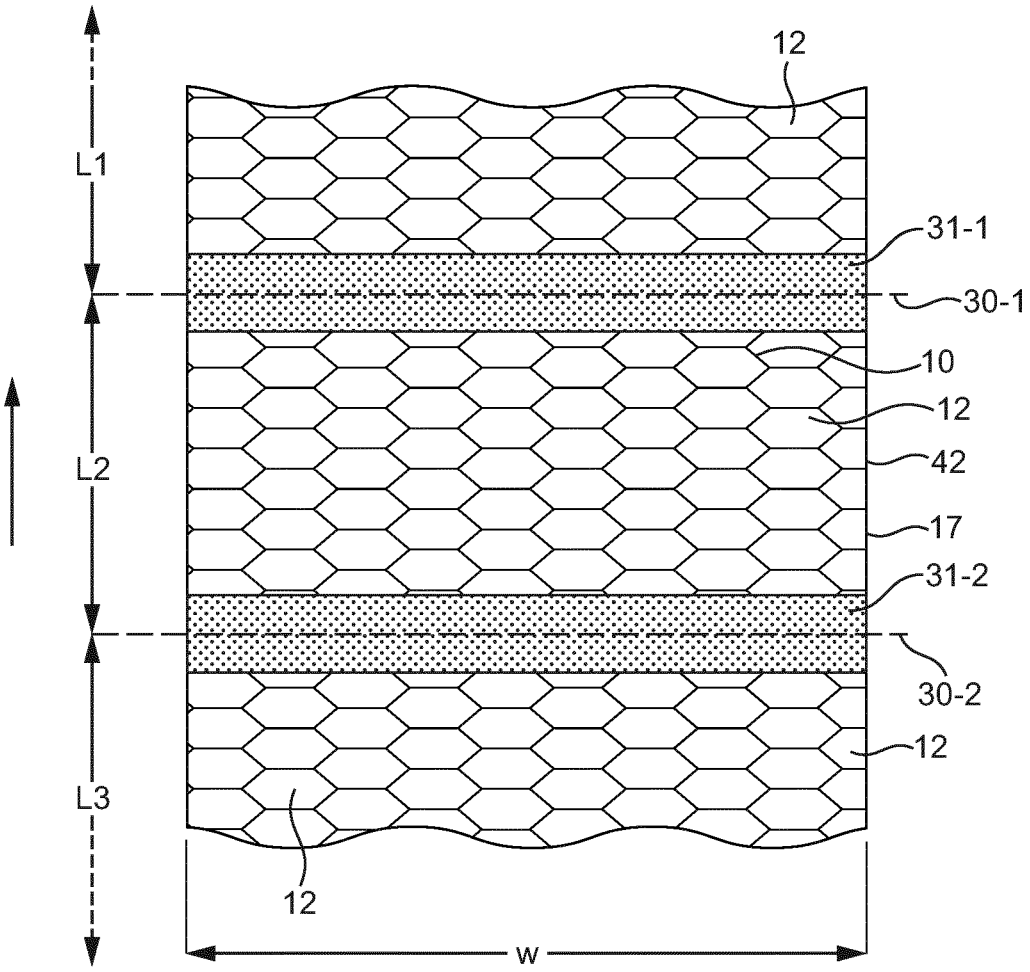
FIG. 16 is a plan view of an embossed web for use in manufacture of the cigarette shown in FIGS. 14 and 15.

An example of the pattern formed on the web 17 is illustrated in FIG. 16 and comprises lines weakness 10 which may be formed by laser cutting, embossing such as pin embossing or any other suitable method, as previously described. The web 17 is made from sheet material such as paper with a weight of 40 gsm or more which gives rise to a particularly well defined pattern when formed into a curved wrapper, particularly above 40, 45, 50, 55, 60, 70, 80 and 90 gsm and up to about 120 gsm. Conveniently, the thickness of the paper is within a range of 50 μm-115 μm for the range of weights 40-90 gsm.

The web is of a width suitable for forming two cigarettes back-to-back in a cigarette making machine as will be explained hereinafter. Each length $L_1$, $L_2$, $L_3$, etc of the web 17 is utilised to form an individual back-to-back cigarette pair and in use, the web 17 is cut along lines 30-1, 30-2, etc. The web 17 is provided with a high level of embossing e.g. pin embossing in transverse regions 31-1, 31-2, etc. in order to make the web compliant and easy to curl in its edge regions around the filter 3.

Figure 18:
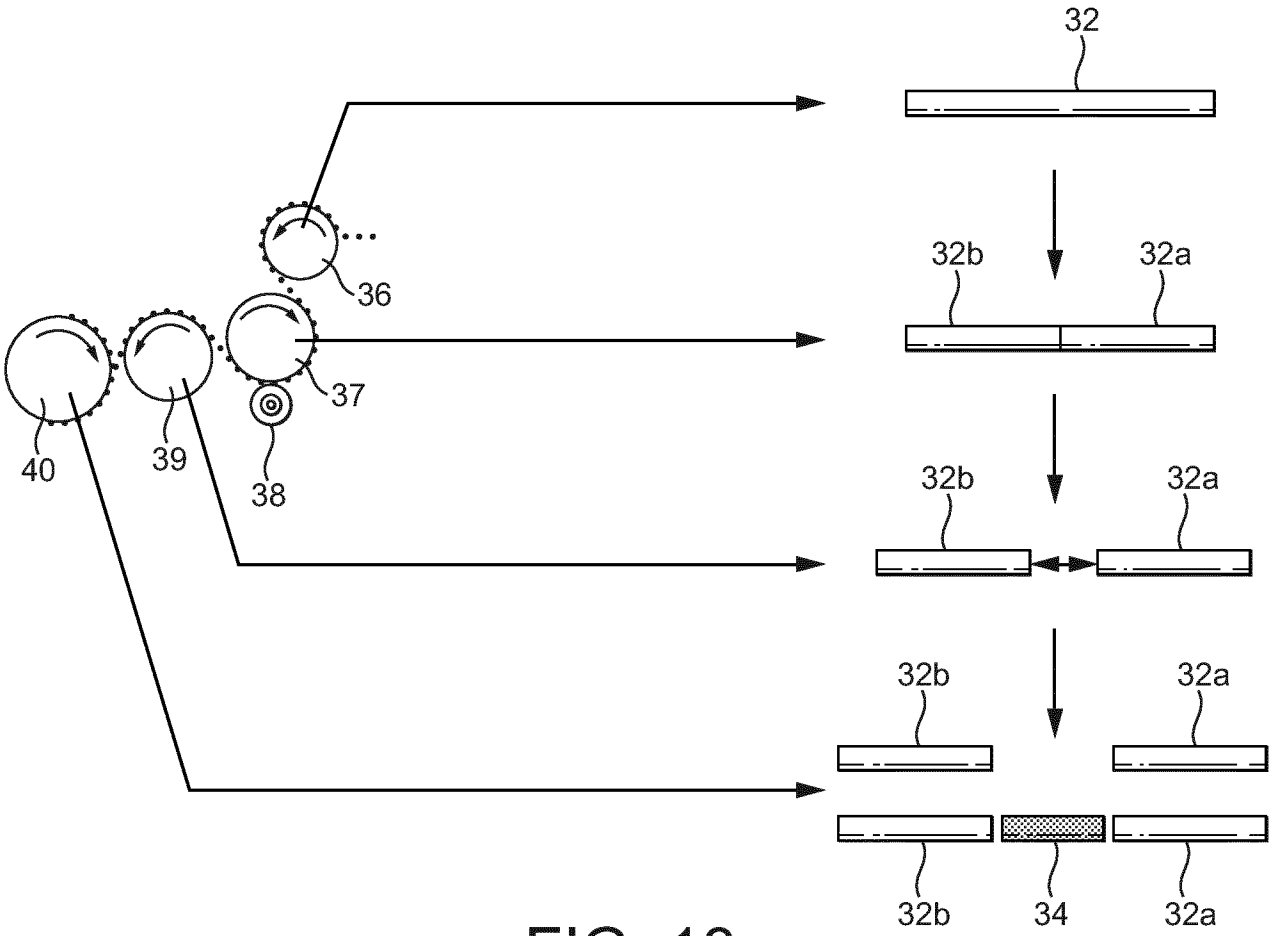
FIGS. 18 and 19 are schematic illustrations of process steps performed by the cigarette making machine shown in FIG. 17.
Figure 19:
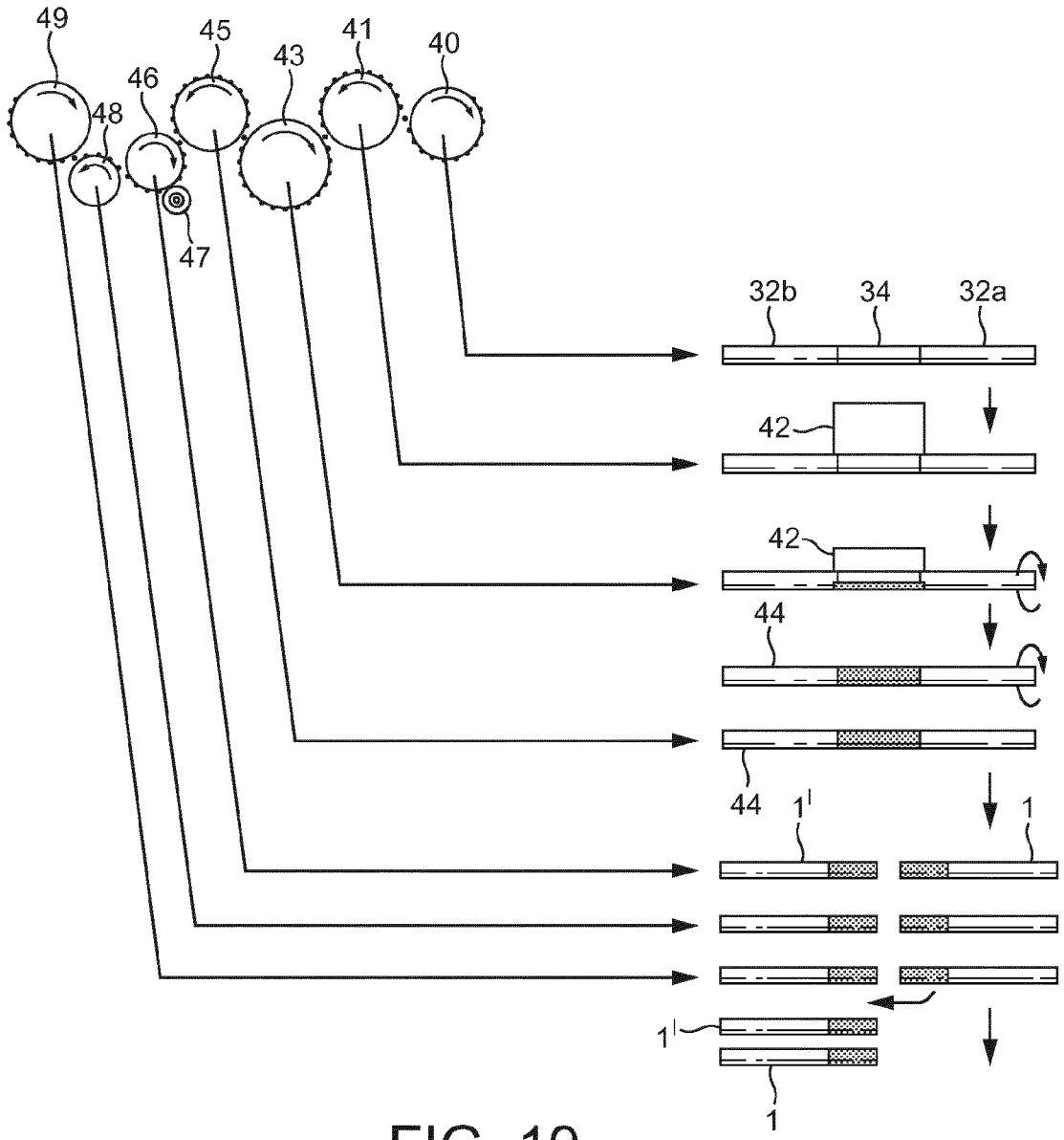

A cigarette making machine suitable for producing cigarettes as shown in FIGS. 14 and 15 will now be described with reference to FIG. 17. The machine can be considered as a modification of a machine by Hauni Maschinenbau AG, which has been adapted to utilise a roll 20 of a tipping material web 17 such as illustrated in FIG. 16 in the manufacture fixed filter cigarettes. Reference is also made to FIGS. 18 and 19, which illustrate schematically the process steps performed by various parts of the machine illustrated in FIG. 17.

Figure 17:
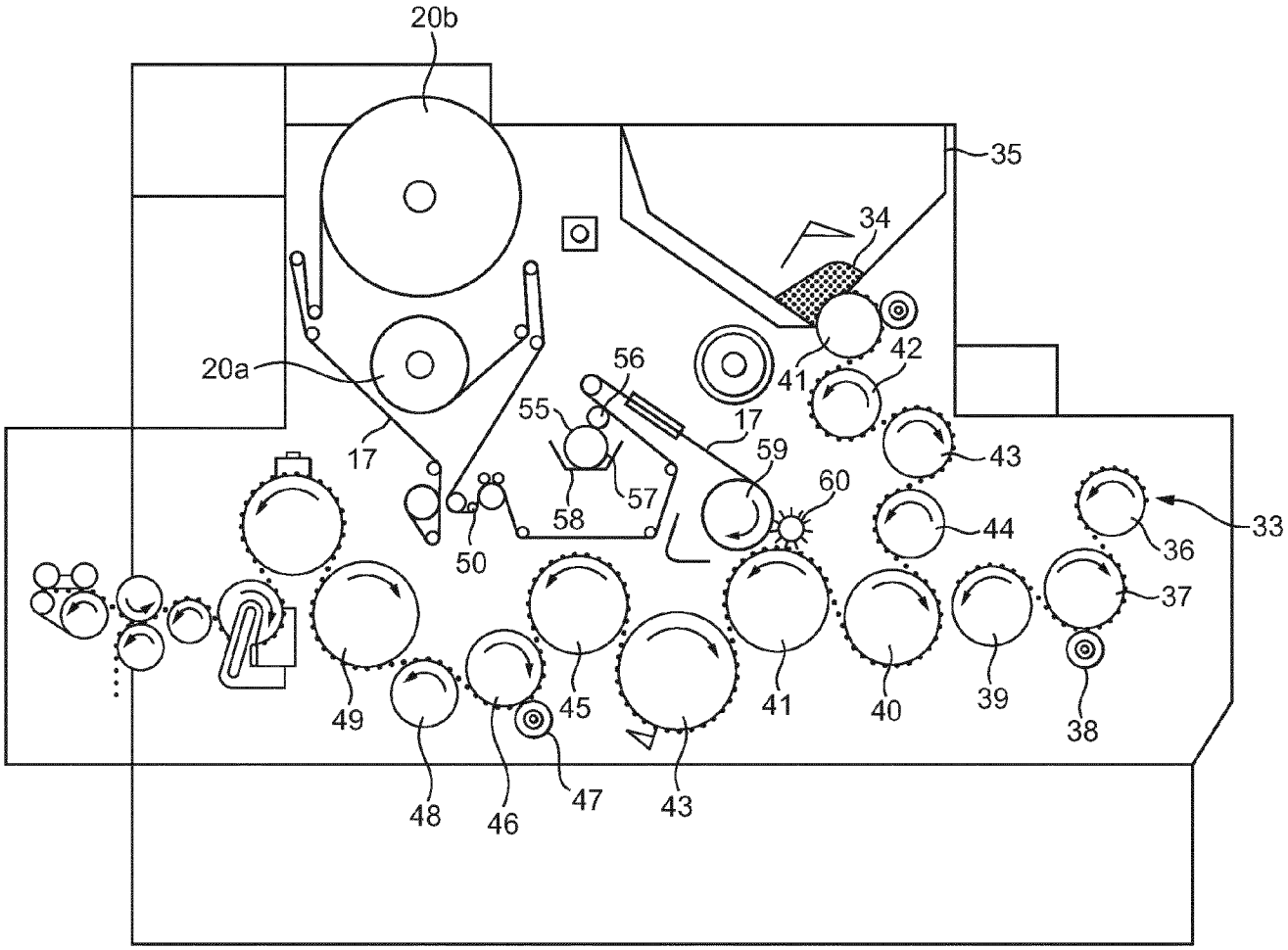
FIG. 17 is a schematic side elevational view of a cigarette making machine.

Tobacco rods 32 of a length suitable for forming two cigarettes back-to-back are supplied to a tobacco rod in-feed 33 shown in FIG. 17. Also, filter rods 34 are supplied from a hopper 35 into the machine. The filter rods 34 are of a length suitable for forming two cigarettes back-to-back.

The tobacco rods 32 are supplied onto a take over drum 36 and passed to a tobacco rod cutting drum 37 with an associated knife wheel 38 that cuts the rods 32 into two parts 32*a*, 32*b* which are then axially separated by means of a separating drum 39 and passed to a filter feed drum 40 where an individual filter rod 34 is placed between them as shown in FIG. 18.

The filter rods are fed from hopper 35 by means of supply rollers 41-44 to the filter feed drum 40 and as shown in FIG. 19, the filter feed drum 40 acts to abut the tobacco rods 32*a*, 32*b* against opposite ends of the filter rods 34 on a common longitudinally axis.

The abutting arrangement of rods 32*a*, 34, 32*b* is then transferred to a swash-plate drum 41 where they are joined together by means of wrapper 42 that comprises a cut portion of the web 17 shown in FIG. 16, e.g. between lines 30-1 and 30-2. As will be explained later, the wrapper portion 42 is cut from the web 17 and is coated with glue so that when the arrangement is transferred to rolling drum 43, the wrapper portion 42 is wrapped around the filter rod 34 and is dimensioned to overlap the ends of the tobacco rods 32*a*, 32*b* so that they become joined together as illustrated by the arrangement 44 in FIG. 19.

The joined rods 44 then pass on to a transfer drum 45 so as to be fed to a cutting drum 46 with an associated rotary knife 47 which cuts the joined rods into two separate cigarettes 1, 1' which are then fed via a transfer drum 48 to a turning drum 49 where the cigarettes 1, 1' of each pair are arranged to face in the same direction ready for packaging.

The web 17 of wrapper material is fed sequentially from a feed arrangement comprising two rolls 20*a*, 20*b* so that a continuous supply of the web 17 can be provided to a cigarette making machine. Thus, when one of the supply rolls 20 becomes exhausted, supply can continue from the other roll and the empty roll can be replaced.

In an alternative, a plain web roll is used and an embossing station for example as shown and described with reference to FIG. 9 is included in the cigarette making machine. Also the web 17 may be embossed at a station adjacent the cigarette making machine and supplied from the adjacent station into the making machine.

Figure 20A:
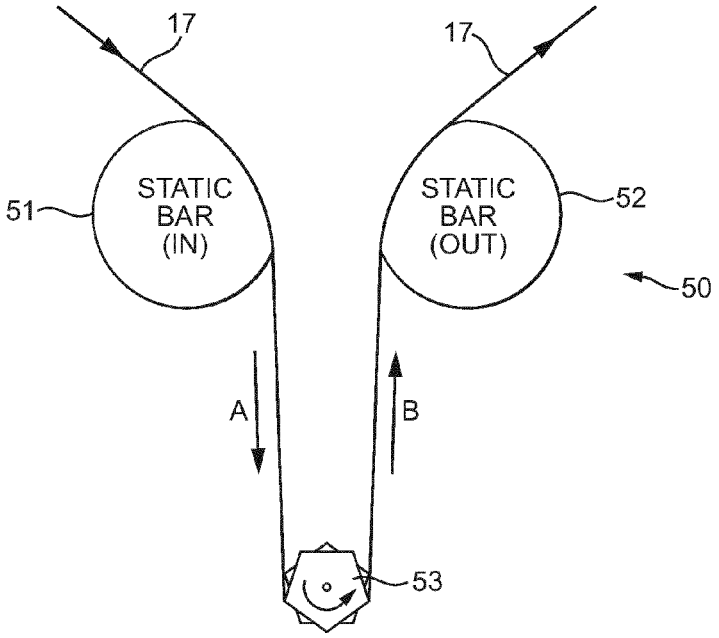
FIG. 20A is a schematic illustration of a curling station in the cigarette making machine of FIG. 17.

Referring again to FIG. 17, the web 17 is fed from one of the rolls 20 to a curling station 50 illustrated in more detail in FIG. 20A. The curling station 50 operates on the web 17 in order to weaken its structural integrity on one side to enable it to curl into a cylinder readily when wrapped around the rods 32*a*, 32*b* and 34 on the drums 41, 43 as shown in FIGS. 17 and 19. Hitherto, tipping paper in conventional cigarette making machines has been passed over a fixed curling edge to weaken the structural integrity of the tipping paper slightly on one face. However, the web 17 is formed with an embossed pattern of facets 12 and so if a fixed edge were used, the facet pattern would be at least partially destroyed. In the arrangement shown in FIG. 20, the web 17 passes over an inlet static bar 51 to a corresponding outlet static bar 52, via a freely rotatable curling roller 53 which is formed with an external pattern of facets 54 shown in FIG. 21A that correspond to the facets 12 on the web 17. The curling roller 53 is free to rotate about axis X-X' and the pattern of facets 54 tends to self-synchronise with facets 12 on the web 17. Also, as the web 17 changes its direction from the inlet (arrow A) to the outlet direction (arrow B) it undergoes a sharp change in direction approaching 180°, which results in the structural integrity of the paper being changed so that it has a propensity to curl, but without destroying the embossed pattern of facets 12, which are maintained due to their synchronism with the facet pattern 54 on the curling roller 53. It will be understood that the rotary curling roller 53 can be retrofitted to a cigarette making machine instead of the conventional fixed blade arrangement used hitherto in such machines.

In a modification, a servo system (not shown) is provided to drive the curling roller 53 to rotate about the axis X-X' rather than allow is to be rotated solely by the passing web 17 as previously described, and an optical detector is provided (not shown) to detect the pattern of the facets 12 on the web 17 to allow the rotation phase of the pattern 54 on curling roller 53 to be maintained in synchronism with the faceted pattern on the web 17, so as not to compromise the web pattern by the curling process.

Figure 22B:
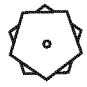
Figure 23B:
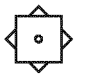
Figure 22A:
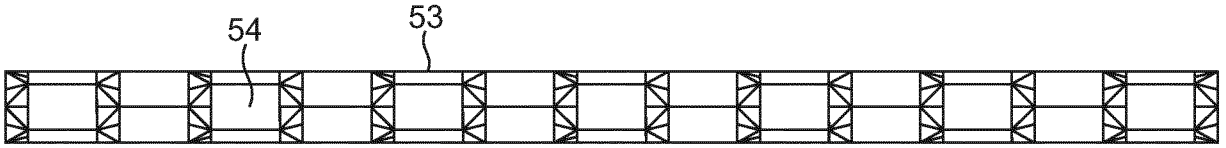
Figure 23A:
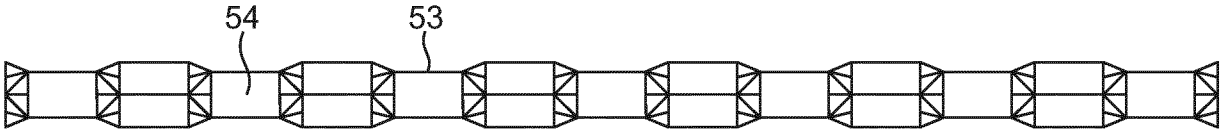

Various patterns of facets may be provided on the curling roller 53, which may be interchangeable, so that the chosen pattern 54 can be complementary to, and mesh in synchronism with the pattern of facets formed on the web 17, and alternative curling roller patterns can be provided to match different web patterns as shown in FIGS. 22 and 23.

Figure 20B:
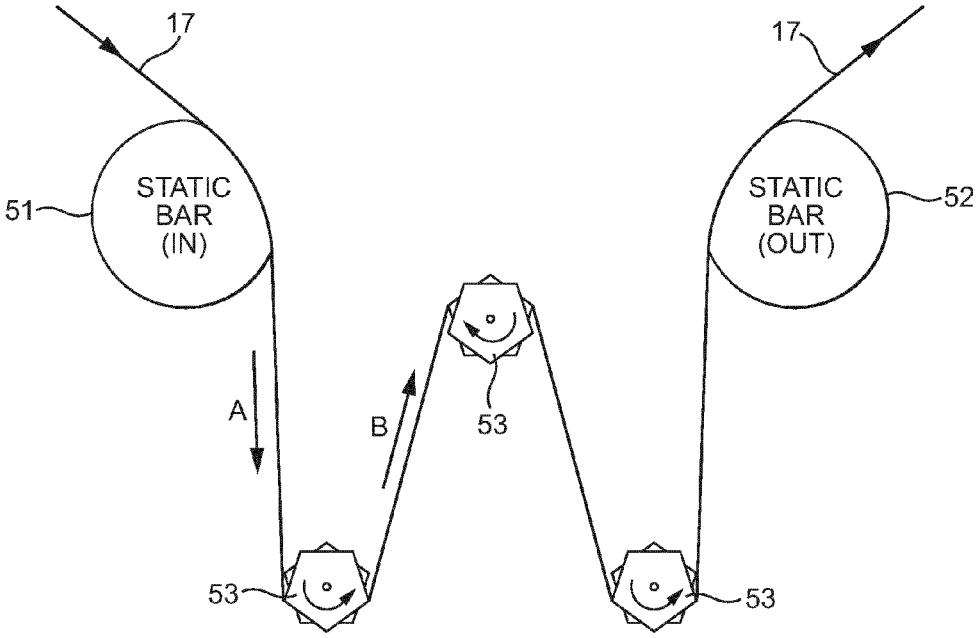
FIG. 20B illustrates a modification to the curling station.
Figure 21B:
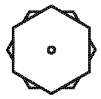
FIGS. 21, 22 and 23A and B illustrate side and end views of different curling bars for use in the curling station of FIG. 20.
Figure 21A:
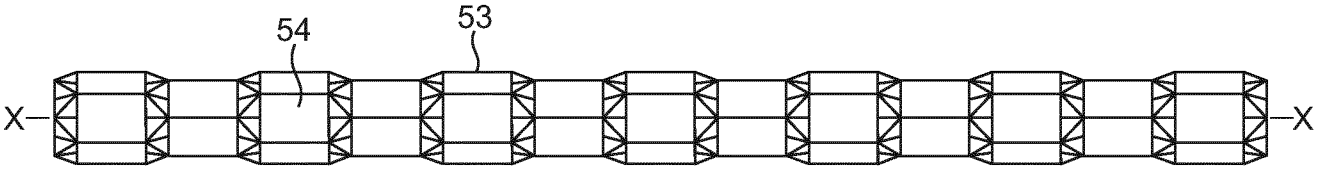

In a modification shown in FIG. 20B, further curling rollers 53 are included, in this example 3, so that the web 17 passes back and forth over them in a serpentine pattern, to weaken the surface of the web 17 on both sides.

Referring to FIG. 17, the web 17 passes from the curling station 50 to a gluing station 55. This includes a gluing roller 56 that applies to predetermined pattern of glue on to one side of the web 17, transferred by a transfer roller 57 from a tray 58. The web 17 with glue applied then passes over a feed roller 59 to a rotary patch cutter 60 that includes a plurality of radially extending blades that cut the web 17 into portions 42 to be applied to successive tobacco and filter rod arrangements as illustrated in FIG. 19.

Referring to FIG. 16, the patch cutter 60 cuts the web 17 along lines 30-1, 30-2, etc. to form the individual wrapper portions 42. In the example shown in FIG. 16, the leading and trailing edges 42*a*, 42*b* of each wrapper portion 42 have been heavily embossed e.g. with pin embossing to render the leading and trailing edges pliable so that they can easily be rolled on top of one another during the rolling process previously described that occurs on the rollers 41, 43. The cut lines 30-1, 30-2 may be arranged so that the leading and trailing edges are of the same dimension, or the heavily embossed leading and trailing edges 42*a*, 42*b* may be made of different sizes e.g. with the leading edge being made wider than the trailing edge or vice versa. A registration servo system (not shown) ensures that the cutting blades of the cutter 60 accurately position the cuts 30-1, 30-2 etc in the web 17.

Figure 24:
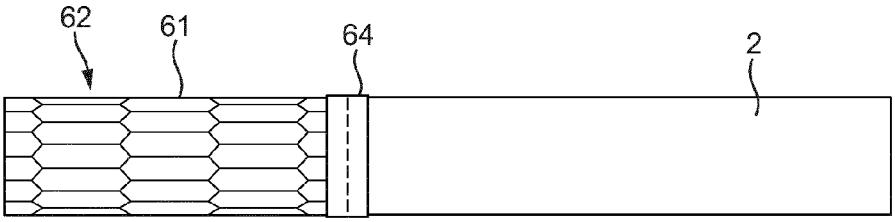
FIG. 24 is a side view of another smoking article comprising a fixed filter cigarette.
Figure 25:
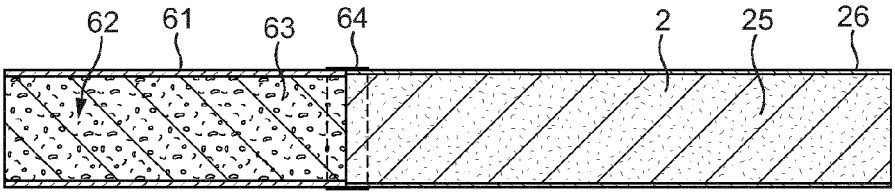
FIG. 25 is a longitudinal sectional view of the cigarette shown in FIG. 24.

Another example of cigarette with a fixed filter is illustrated in FIGS. 24 and 25. In this example, an embossed wrapper 61 is used as a plug wrap for a filter segment 62 that contains any suitable filtration material such as cellulose acetate tow 63, with or without additives such as flavourants or adsorbents. The embossed wrapper 61 may be made from sheet material such as paper e.g. tipping paper with a weight of 40 gsm or more to give rise to a particularly well defined pattern when formed into the curved wrapper, particularly above 40, 45, 50, 55, 60, 70, 80 and 90 gsm and up to about 120 gsm Conveniently, the thickness of the paper is within a range of 50 μm-115 μm for the range of weights 40-90 gsm.

The filter segment 62 is abutted against one end of a tobacco rod 2 that contains tobacco or like smokeable material 25 which is wrapped by an outer wrapper 26. In the example illustrated in FIGS. 24 and 25, the filter segment 62 is attached to the rod 2 by means of an attachment strip 64 which is adhered to the abutting ends of the filter segment 62 and rod 2. The attachment strip 64 may be made of paper or other suitable sheet material and may for example include embossing or printing (not shown) to identify a particular brand of cigarette.

Figure 26:
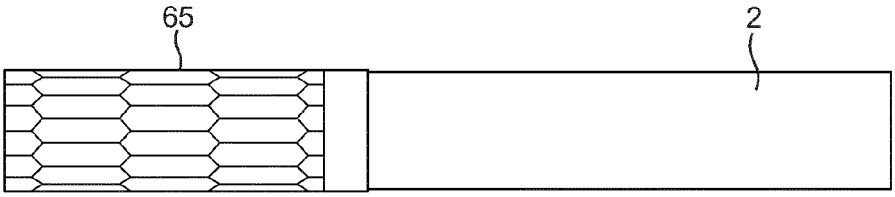
FIG. 26 is a side view of a further smoking article comprising a fixed filter cigarette.
Figure 27:
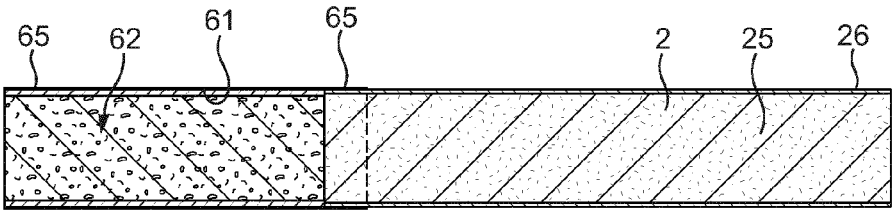
FIG. 27 is a longitudinal sectional view of the cigarette shown in FIG. 27.

Another example is shown in FIGS. 26 and 27 in which the filter segment 62 described with reference to FIGS. 24 and 25, with its embossed plug wrap 61, abuts tobacco rod 2 and is held in place by a thin wrapper 65 that extends the entire length of the embossed plug wrap 61 and over the abutting end of the tobacco rod 2. The wrapper 65 may be a relatively thin paper material that is sufficiently compliant to adhere closely to the embossed pattern of facets on the plug wrap 61 so that the pattern shows through the paper 65 and is thereby visually discernable from the outside. For example, the paper 65 may comprise tissue paper that have been pre-soaked in an aqueous adhesive.

Figure 28:
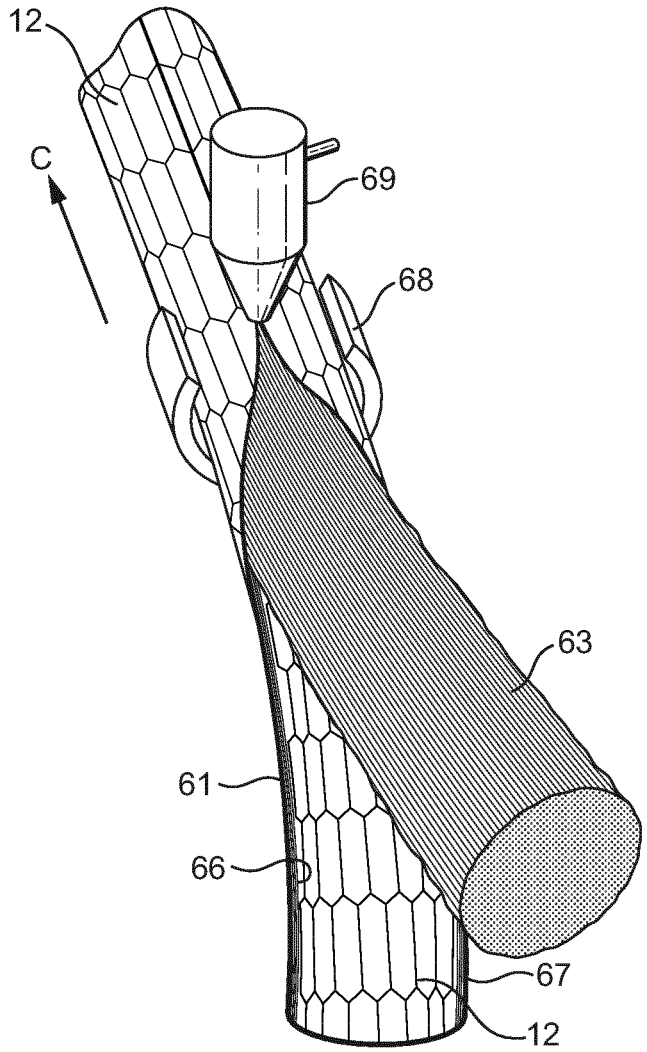
FIG. 28 is a schematic illustration of a process for making a filter rod to provide filters for the cigarettes shown in FIGS. 24-27.

A schematic illustration of a method of manufacturing a filter rod with an embossed plug wrap 61 containing a cellulose acetate tow 63 is illustrated in FIG. 28. A web 65 that is provided with an embossed pattern e.g. facets 12 and heavily pin embossed side edges 66, 67, is fed through a guide 68, for instance the 'garniture' section of a filter making apparatus, that wraps the plug wrap around the tow 63 to form a cylindrical rod 68 that moves on a continuous basis in the direction of arrow C. The side edges 66, 67 are glued to one another by means of a glue gun 69. Alternatively, the side edges 66, 67 can be coated with glue upstream. The resulting rod 68 can then be cut into segments for use with individual cigarettes. The segments can be either of a length suitable for an individual cigarette as shown in FIGS. 24-27 or, can be cut in length suitable for two cigarettes manufactured back-to-back in a manner previously described with reference to FIG. 17, in which case the machine of FIG. 17 is modified to apply either the wrapper 64 or 65. In a modification, the tow 63 is initially wrapped with a relatively lightweight plug wrap and the web 17 is applied as shown in FIG. 28 over the pre-wrapped tow.

An example of the web of embossed plug wrap 61 is illustrated with the heavily embossed side edge regions 66, 67 clearly shown, comprising longitudinal lines of embossing at the side edges more compliant and suited to gluing with a glue gun e.g. with PVA as shown in FIG. 28.

Figure 29:
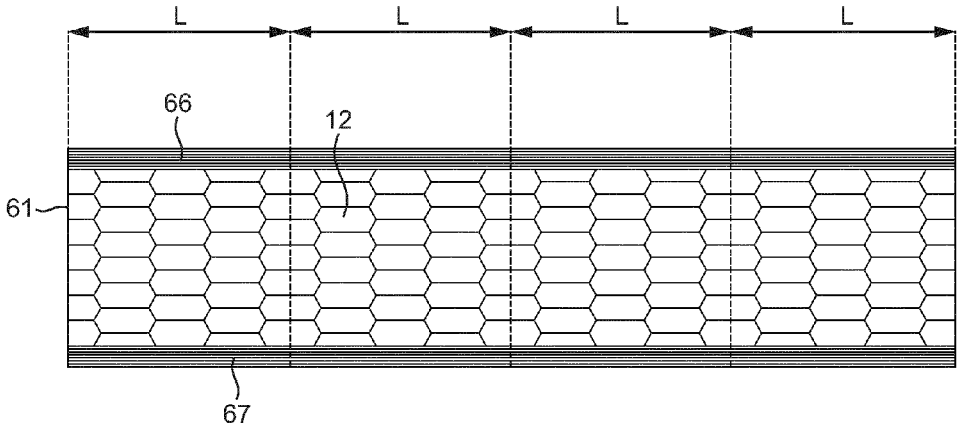
FIG. 29 is a schematic plan view of a web for use as a plug wrap with a line embossed lap seam in filter rod making process.
Figure 30:
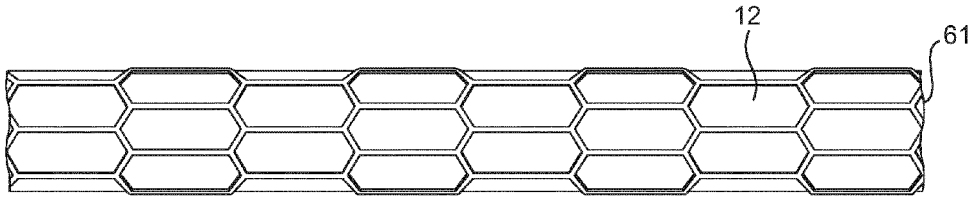
FIG. 30 illustrates the resulting filter rod.

FIG. 29 illustrates another example of an embossed wrapper 61 that can be used to manufacture a filter rod of a length corresponding to 4 filter rod segments for individual cigarettes, and FIG. 30 illustrates the filter rod formed from the wrapper of FIG. 29, with the pattern of facets 12 clearly shown. The facets 12 may be formed by the use of a die arrangement (not shown) comprising die members that can impress the pattern of facets 12 into web 61. The longitudinal side edges 66, 67 comprise lap seams that are line embossed for example by the use of a suitable die arrangement (not shown). To form the filter rod, the wrapper 61 of FIG. 29 is wrapped around a tow of filter material and the lap seams 66, 67 are overlapped and glued to one another. A glue gun similar to that shown in FIG. 28 may be used either with a PVA glue or a hot melt.

Figure 31A:
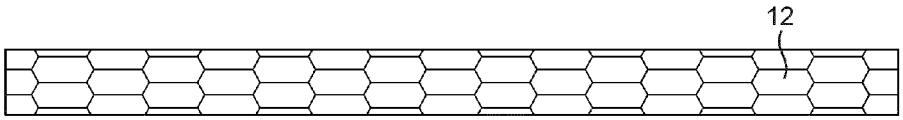
FIG. 31A also illustrates the resulting filter rod highlighting its pattern of embossed facets.
Figure 31B:
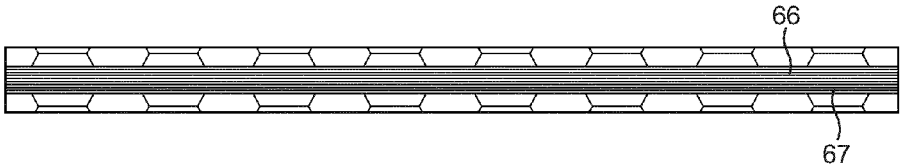
FIG. 31B illustrates the rod and its line embossed side edges that form a lap seam.
Figure 32A:
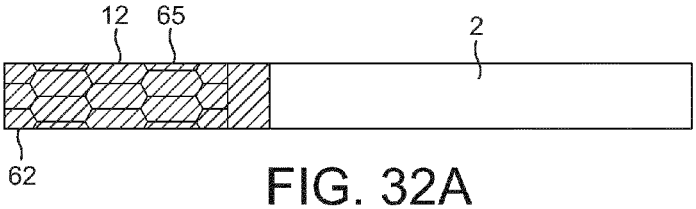
FIG. 32A illustrates a cigarette manufactured using the filter rod of FIGS. 30 and 31.
Figure 32B:
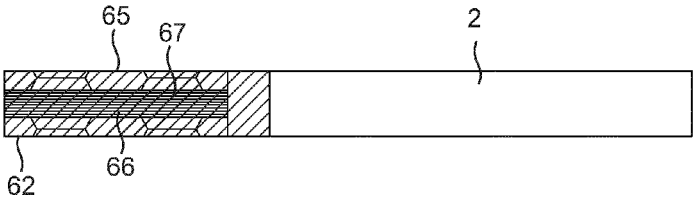
FIG. 32B illustrates the cigarette and the line embossed longitudinal side edges of the plug wrap.

The resulting filter rod is also shown in FIG. 31. FIG. 31A shows the pattern of facets 12 clearly whereas FIG. 31B illustrates the seam that results from the seam bonding produced by the glue gun of the heavily embossed lap seam edge regions 66, 67. In the example shown in FIGS. 29, 30 and 31, the rod is of the length 4×l corresponding to 4 filter rod segments of length l for individual cigarettes. The filter plug can be used to form individual cigarettes for example as illustrated in FIGS. 26 and 27 in which a filter segment 62 of length l is attached to a tobacco rod 2 by a thin, overlying wrapper of tipping paper 65. The arrangement is also shown in FIG. 32A, and in FIG. 32B, the seam formed by the line embossed lap seam edge regions 66, 67 is clearly shown. The line embossed edge regions are radially compliant in relation to the filter rod so that they can readily conform the curvature of the filter rod so as to provide a lap seam along their longitudinal side edges and provide a glue joint that is longitudinally consistent and airtight to provide a user acceptable filter action in the eventual cigarette. Also, the longitudinal line embossing in the lap seam edge regions 66, 67 permits a rod of improved circularity when viewed in transverse section, and due to the overlapping longitudinal side edges, is smooth to the touch for the user of a cigarette incorporating the filter. Also, there is no requirement to align the facets 12 and improved adhesion is achieved.

Figure 33:
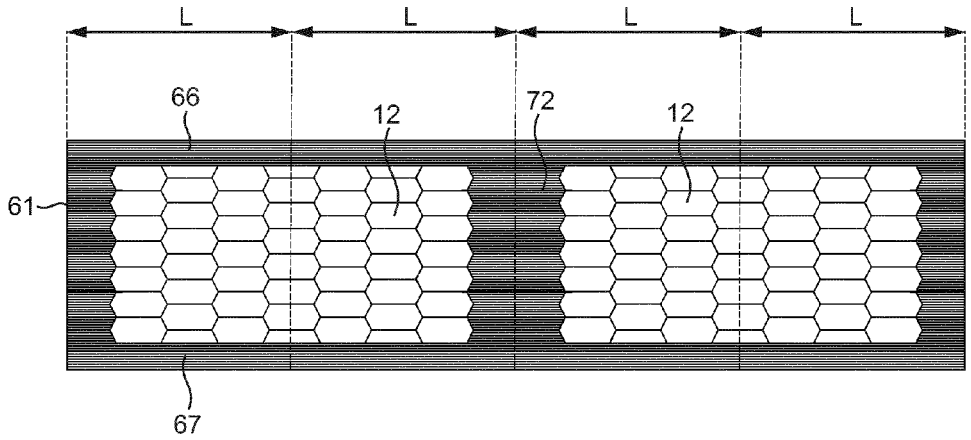
FIG. 33 illustrates an alternative web with a lap seam for use as a plug wrap in a filter rod making process shown in FIG. 28.

FIG. 33 illustrates another example of plug wrap 61 that can be used. In this example, the plug wrap 61 is embossed as previously described to provide the pattern of facets 12 and the line embossed lap seam edge regions 66, 67. The plug wrap 61 of FIG. 33 is also embossed with a transverse line embossed region 72 that extends transversely across the plug wrap so as to be repeated at a distance of 2l. As previously explained with reference to FIGS. 18 and 19, the filter plug can be used to form pairs of cigarettes back-to-back and the transverse line embossed region 72 is configured so as to provide an embossed region adjacent the join of the filter to the tobacco rod so as to provide a convenient grip for the fingers of the user. The resulting embossed filter rod is illustrated in more detail in FIG. 34 and FIG. 35A, with the lap seam edges 66, 67 shown in detail in FIG. 35B.

Figure 36A:
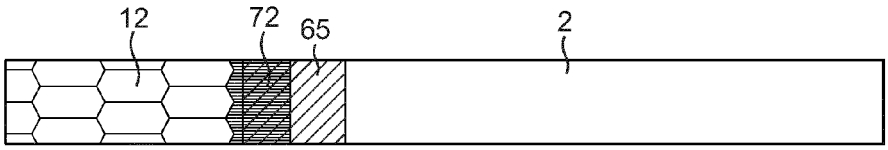
FIG. 36A illustrates a filter cigarette made with the filter rod of FIGS. 34 and 35.
Figure 36B:
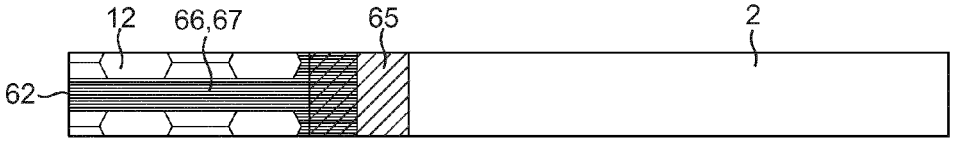
FIG. 36B illustrates the filter cigarette of FIG. 36A and the glued overlying lap seams of the filter rod.
Figure 36C:
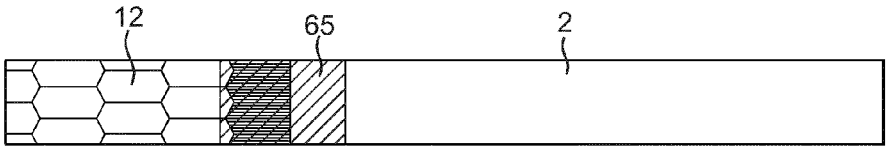
FIGS. 36C-E are views corresponding to FIG. 36 B with different widths of tipping paper connecting the filter segment to the tobacco rod.
Figure 36D:
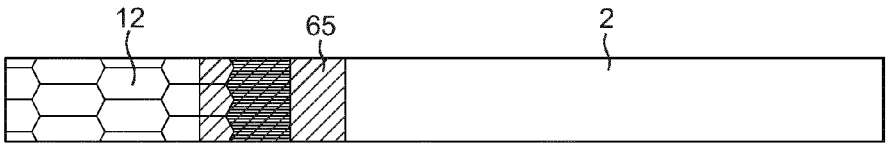
Figure 36E:
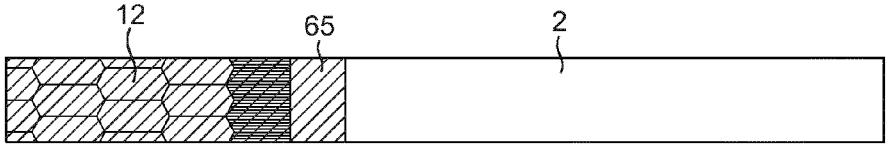

The resulting filter cigarette is illustrated in FIGS. 36A, B with the line embossed regions 72 abutting the tobacco rod 2. The tipping paper 65 used to attach the filter segment 12 to the tobacco rod 2 can be of different widths to cover only a small extent of the filter segment as shown in FIG. 36A or may extend over progressively larger parts of the filter segment as shown in FIGS. 36C and D or to cover the entire filter surface as shown in FIG. 36E.

Figure 34:
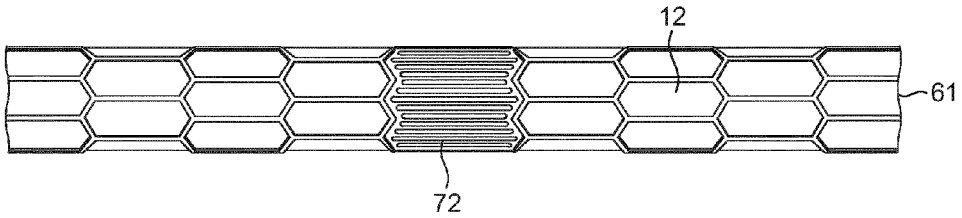
FIG. 34 illustrates the resulting filter rod produced from the plug wrap shown in FIG. 33.
Figure 35A:
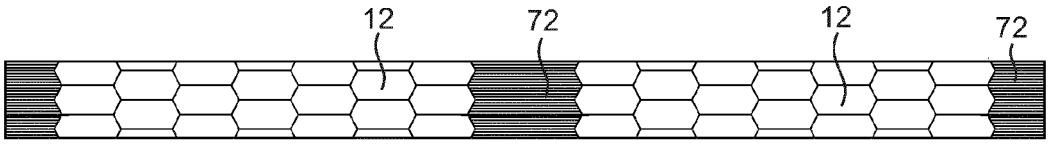
FIG. 35A illustrates the filter rod produced from the plug wrap shown in FIG. 33.
Figure 35B:
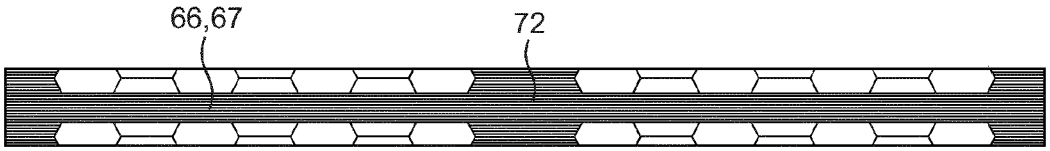
FIG. 35B illustrates the filter rod of FIG. 35 and its glued overlapping, embossed lap seams.

The papers used in the production of the plug wraps 61 shown in FIGS. 29 and 34 may comprise a stiff, non-porous plug wrap having a weight in the range of 80-200 gsm, more particularly 80-150 gsm or 90-150 gsm and, by way of example 100-130 gsm. Specific examples include 100 gsm, 115 gsm and 125 gsm for papers supplied by Defort Feurstein to provide filter segments of length l=27 mm. With the circumference of 24.3 mm, it has been found that an increase of the paper weight in gsm within the aforesaid ranges, results in a reduced likelihood of leak paths through the filter occurring in the region 72 and providing a better adhesion of the plug wrap at the filter end. Also, the increased weight may tend to reduce bulging that can be caused by the pressure of compressed tow within the filter rod during manufacture of the rod.

The fixed filter cigarettes described above may comprise a combination of two or more different segments of filtration material. For example, with reference to the cigarette of FIGS. 14 and 15, the generally cylindrical filter segment 3 may be formed of a charcoal filter segment abutting a segment of cellulose acetate, wrapped together in the plug wrap 28. Alternatively, each of the different segments of filtration material may be separately wrapped in plug wrap, and the tipping wrapper 29 may attach the combined filtration segments to the tobacco rod 2.

Moreover, with reference to the cigarette of FIGS. 24 and 25, the filter segment 62 may be formed of two or more different segments of filtration material wrapped together in the embossed wrapper 61. Alternatively, each of the different segments of filtration material may be separately wrapped in plug wrap, and held together by the embossed wrapper 61.

Furthermore, with reference to the cigarette of FIGS. 26, 27, 32A, 32B and 36A to 36E, the filter segment 62 may be formed of two or more different segments of filtration material wrapped together in the embossed wrapper 61. Alternatively, each of the different segments of filtration material may be separately wrapped in plug wrap, and held together by the embossed wrapper 61. As a further alternative, each of the different segments of filtration material may be separately wrapped in embossed wrapper 61, and may be held together by the thin wrapper 65.

Many modifications and variations to the described smoking articles and their components fall within the scope of the invention. For example, the lines of weakness 10 can be formed on the outside of the wrapper to achieve the visually discernable facets 12.

The production of the lines of strength discontinuity may involve burning to produce a discernable pattern around the perimeters of the facets to enhance the visual effect. For example the cutting may involve burning. Also, the burning can mimic printing to permit logos and the like to be applied to the wrapper.

Also, a structural coating such as a varnish can be applied e.g. by printing onto the paper to rigidify the paper and thereby define the facets. This could be printed on the inside or outside depending on the finish required. Alternatively, the varnish can be printed in lines to form borders around the facets.

Also, the lines of strength discontinuity need not be lines of weakness and can be lines of strength formed for example by printing patterns of starch onto the sheet material in order to produce local stiffening.

In order to address various issues and advance the art, the entirety of this disclosure shows by way of illustration various embodiments in which the claimed invention(s) may be practiced and provide for superior wrappers, plug wraps, filters and smoking articles and methods of making them. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article component comprising a curved sheet wrapper consisting of a single sheet of material and having a weight of at least 40 gsm and including a plurality of lines of strength discontinuity whereat the wrapper presents a visually discernable non-uniformity in a curvature thereof, wherein the lines of strength discontinuity are configured to define a plurality of planar facets having a closed perimeter over the sheet wrapper, the wrapper comprises a generally rectangular web of sheet material embossed with a regular pattern of facets and lap seams along opposing side edges formed with line embossing in the regions of the lap seams.

2. The smoking article component according to claim 1, wherein the wrapper having a weight of at least 45 gsm.

3. The smoking article component according to claim 1, wherein a thickness of the wrapper is within a range of 50 μm-115 μm.

4. The smoking article component according to claim 1, wherein the plurality of lines of strength discontinuity comprises lines of weakness.

5. The smoking article component according to claim 4, wherein the lines of weakness comprise partial cuts into a thickness of the sheet material.

6. The smoking article component according to claim 1, the wrapper further including spaced bands of lines embossing extending transversely across the wrapper.

7. The smoking article component according to claim 1, wherein the lines of strength discontinuity are disposed on the inner surface of the curved sheet wrapper.

8. The smoking article component according to claim 1, wherein the curved sheet wrapper is formed into a tubular configuration.

9. The smoking article component according to claim 1, wherein the radius of curvature of the planar facets is different from the radius of curvature of the inner surface of the curved sheet wrapper.

10. The smoking article component according to claim 1, wherein the curved sheet wrapper comprises a first array of facets disposed over a first part of the sheet wrapper and a second array of facets disposed over a second part of the sheet wrapper, wherein the second array of facets have a shape different from the first array of facets.

11. The smoking article component according to claim 1, wherein the curved sheet wrapper has a basis weight of greater than 60 gsm.

12. The smoking article component according to claim 1, wherein the curved sheet wrapper has a basis weight of greater than 85 gsm.

13. The smoking article component according to claim 1, wherein the curved sheet wrapper has a basis weight of greater than 100 gsm.

14. The smoking article component according to claim 1, wherein the curved sheet wrapper is embossed with a transverse line embossed region extending transversely across the wrapper.

15. A smoking article comprising:

the smoking article component according to claim 1; and at least one of a filter and a tobacco rod having a curved surface that is wrapped with the wrapper.

16. The smoking article according to claim 15, the smoking article comprising the filter and the tobacco rod, wherein the filter includes a plugwrap and the wrapper overlies at least a portion of a plugwrap and the tobacco rod to join the filter and the tobacco rod together.

17. A filter rod including the smoking article component according to claim 1 as a plug wrap.

18. A smoking article including the filter rod according to claim 17 and a tobacco rod, wherein a wrapping overlies at least a portion of the plug wrap and the tobacco rod to join them together.

* * * * *